US005314250A

United States Patent [19]

Lee

[11] Patent Number: 5,314,250

[45] Date of Patent: May 24, 1994

[54] INFLATABLE CONTAINER

[76] Inventor: Ung L. Lee, 193 Tumblebrook Dr., South Windsor, Conn. 06074

[21] Appl. No.: 62,834

[22] Filed: May 18, 1993

[51] Int. Cl.[5] ..... B65D 33/00

[52] U.S. Cl. ..... 383/3; 383/6; 383/93; 383/104

[58] Field of Search ..... 383/6, 3, 93, 104; 220/420, 426, 428; 206/522

[56] References Cited

U.S. PATENT DOCUMENTS 4,044,867 8/1977 Fisher ..... 383/3 X
4,574,953 3/1986 Garbuzov ..... 383/3 X
4,858,755 8/1989 Kuivanen ..... 383/3 X
4,867,576 9/1989 Boyd ..... 383/3 X
4,941,754 7/1990 Murdock ..... 383/3

*Primary Examiner*—Allan N. Shoap
*Assistant Examiner*—Jes F. Pascua
*Attorney, Agent, or Firm*—Birch, Stewart, Kolasch & Birch

[57] ABSTRACT

An inflatable container includes a plurality of vertical air conduits, a horizontal air conduit, and a one-way valve. A self-adhesive material may be formed on the container whereby upon inflating the container, the container self-stands and can be adhered to a wall or table.

12 Claims, 2 Drawing Sheets

INFLATABLE CONTAINER

BACKGROUND OF THE INVENTION

1. Field of the Invention

The present invention relates to an inflatable container which includes a plurality of vertical air conduits disposed in container walls and a horizontal, annular air conduit disposed at an opening thereof, and a one-way valve communicating with the vertical and horizontal air conduits, whereby the air conduits are inflatable so that the container stands automatically.

2. Description of Related Art

Generally, folded flat plastic bags are used to collect trash. However, it is difficult to put the trash into the limp plastic bags without some special additional support for the bag. Often, another party must help hold open the bag or a special instrument is used so as to open the opening of the plastic bag. Also, the folded flat plastic bags may require a rigid trash can for supporting the plastic bags. The rigid trash cans are not disposable and usually must be hidden under a desk or table so that it becomes uneconomical and spoils the beauty of ones surroundings.

SUMMARY OF THE INVENTION

Accordingly, it is an object of the present invention to provide an inflatable container, bag, and the like.

Another object of the present invention is to provide an inflatable container which includes a plurality of vertical air conduits disposed in confronting side walls, a horizontal, annular air conduit disposed at the opening thereof, and a one-way valve communicating with the vertical air conduits through the horizontal air conduit whereby upon inflating the air conduits, the inflated container stands automatically.

A further object of the present invention is to provide an inflatable container which further includes a strip of self-adhesive for adhering the container to a wall or a lower portion of a table or desk.

Still another object of the present invention is to provide an inflatable container which further includes an inflatable, rectangular and horizontal air conduit having a smaller diameter passage disposed at four corners, and a vertical corner quilt sealing disposed at four vertical corners thereof for effectively assisting self-standing while the container inflates.

Briefly described, the present invention relates to an inflatable container which comprises a plurality of vertical air conduits, a horizontal air conduit and a one-way valve, and a self-adhesive material whereby upon inflating the container, the container is self-standing and can be adhered to a wall or table.

Other objects and further scope of applicability of the present invention will become apparent from the detailed description given hereinafter. It should be understood, however, that the detailed description and specific examples, while indicating preferred embodiments of the invention, are given by way of illustration only, since various changes and modification within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF PREFERRED EMBODIMENTS

Figure 1:
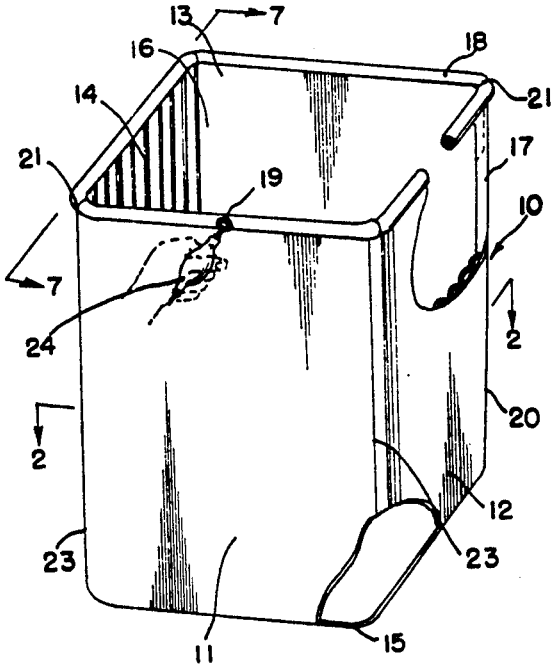
FIG. 1 is a perspective view of an inflatable container according to the present invention in a fully inflated position, showing in cut away portions thereof the basic components of the present invention.
Figure 2:
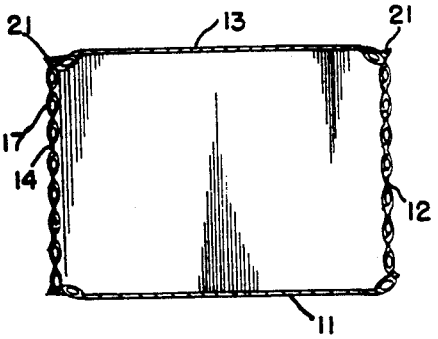
FIG. 2 is a cross-sectional view of FIG. 1, taken along line 2—2, showing a plurality of vertical air conduits disposed in confronting walls of the inflated container according to the present invention.
Figure 3:
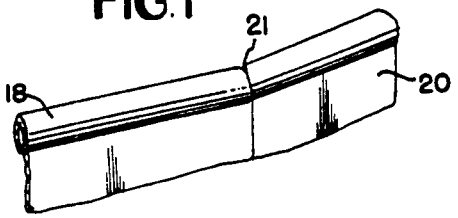
FIG. 3 is a perspective view of a horizontal air conduit in a fully inflated position.

Referring now in detail to the drawings for the purpose of illustrating preferred embodiments of the present invention, the inflatable container 10 as shown in FIGS. 1, 2, and 3, comprises a plastic bag 20 having a first wall 11, a second wall 12, a third wall 13, a fourth wall 14, a bottom wall 15 and an upper opening 16, a plurality of vertical air conduits 17 disposed in confronting walls such as the second and fourth walls 12 and 14 and/or the first and third walls 11 and 13, and a horizontal, annular air conduit 18 disposed at a perimeter of the opening 16 for self-standing during inflation.

Figure 7:
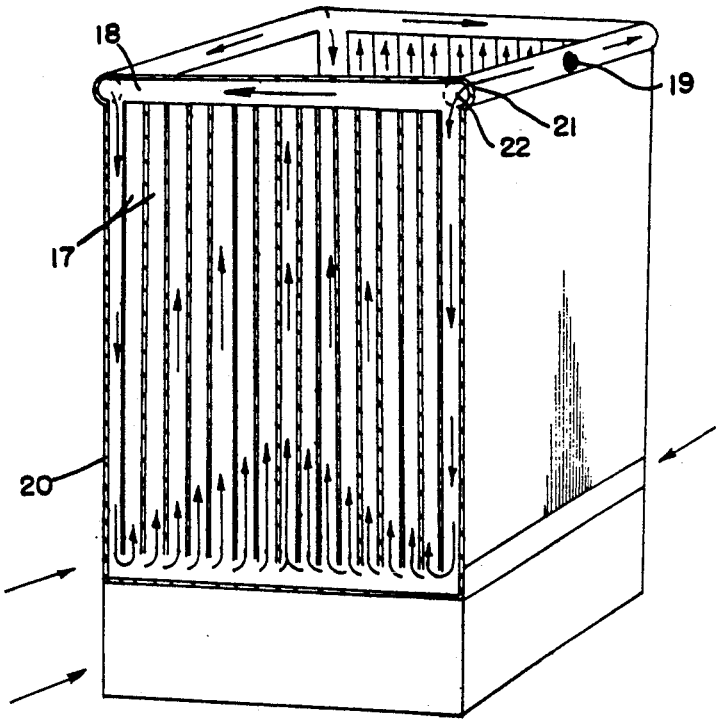
FIG. 7 is a sectional view of FIG. 1, taken along line 7—7, showing the air flow within the container.

The horizontal air conduit 18 is provided with a one-way valve 19 and an air pump 24 detachably secured to the one-way valve 19 for inflating the container if necessary. Also, the horizontal air conduit 18 communicates with the vertical conduits 17 (FIG. 7).

Figure 4:
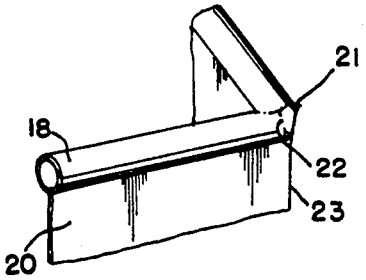
FIG. 4 is a perspective view of the horizontal air conduit in a fully inflated position, showing automatic bending of a corner of the container as result of a smaller diameter passage thereof.

As shown in FIGS. 3 and 4, the horizontal conduit 18 usually has four bending areas or corners 21 wherein each bending area 21 has a small diameter passage 22 for automatic bending while the horizontal conduit 18 is inflated (FIG. 4). The horizontal conduit 18 can include at least three bends so that depending on the number of bends, the inflated container has a numbered hedron. Preferably the container of the present invention is a tetrahedron.

The vertical and horizontal air conduits 17 and 18 are formed by heat-sealing layers such as the inner and outer plastic bag layers or by a conventional manner.

Figure 5:
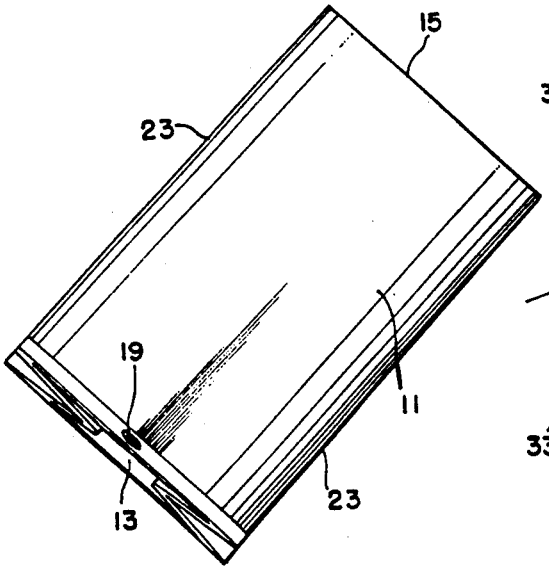
FIG. 5 is a front view of the folded inflatable container according to the present invention.

In order to more easily self-stand the inflatable container, the plastic bag 10 is provided with a quilt seal 23 along the four corner edges during inflation thereof. The inflatable container of the present invention can be folded along the quilt seal 23 during inflating as shown in FIG. 5.

Figure 6:
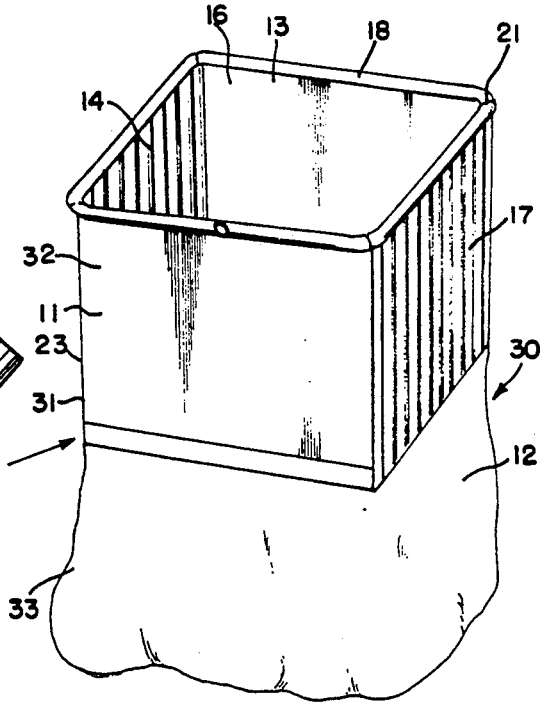
FIG. 6 is a perspective view of the inflated container employing another preferred embodiment of the present invention.

Referring in detail to FIG. 6, there is illustrated an additional embodiment of an inflatable container 30 in accordance with the present invention. The inflatable container 30 includes a plastic bag 31 which is the same as the plastic bag 20 except for a lower portion 33 which does not include a plurality of air conduits. Therefore, when trash is put into the container 30 the lower portion 33 of container 30 supports an upper portion 32 thereof, and the container 30 forms a kind of rigid container.

Figure 8:
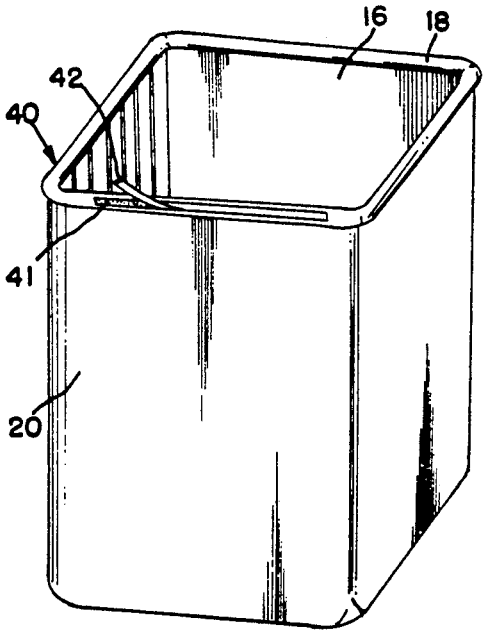
FIG. 8 is a perspective view of the inflated container with a strip of self-adhesive employing a third preferred embodiment of the present invention.

Referring in detail FIG. 8, there is illustrated a third embodiment of an inflatable container 40 in accordance with the present invention. The inflatable container 40 includes the plastic bag 20 which is provided with a self-adhesive material 41 covered by a protective strip 42 which prevents the self-adhesive material 41 from contacting and adhering to a surface while the container 40 is being handled prior to being set in place such as against a wall, the lower portion of a table, or the like.

Figure 9:
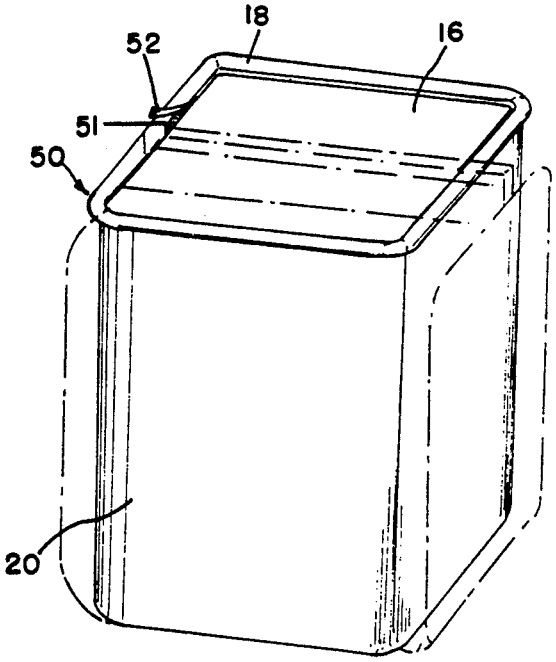
FIG. 9 is a perspective view of the inflated container with a strip of self-adhesive employing a fourth preferred embodiment of the present invention.

Referring in detail to FIG. 9, there is illustrated a fourth embodiment of an inflatable container 50 in accordance with the present invention. The inflatable container 40 includes the plastic bag 20 which is provided with a self-adhesive material 51 disposed on an inside of the upper perimeter of the horizontal air conduit 18. Preferably, the self-adhesive material 41 is covered by a protective strip 52 for protecting the self-adhesive material 41 from contacting and adhering to a surface. The self-adhesive material and protective strip 52 are formed around about half of the circumference the opening 16. Therefore, after the container 50 is used, for example, for packing, the opening 16 is sealed by adhering the self-adhesive material 51 to the opposite outer surface of the horizontal air conduit 18 as shown in a dotted line drawing in FIG. 9.

The inflatable containers 10, 30, 40 and 50 of the present invention operate as follows: As shown in FIGS. 1 and 7, upon operating the air-pump 24, air is introduced into the horizontal air conduit 18 through the one-way valve 21. The air flows in the direction indicated by arrows B, C, and D from arrow A until the container 10 is inflated. Because the plurality of vertical air conduits are open at the bottom and closed at the top thereof, the container is fully inflated so that the container self-stands effectively.

Thus, the inflatable container 10 includes horizontal and vertical air conduits to be inflated, whereby upon inflating, the container 10 self-stands from a folded position (FIG. 5) to a fully upright position (FIG. 1) as a result of the support function of the plurality of vertical inflated air conduits and the frame function of the horizontally rectangular inflated air conduits by the air-pumping action of the air pump 24 through the one-way valve 19.

The invention being thus described, it will be obvious that the same may be varied in many ways. Such variations are not to be regard as a departure from the spirit and scope of the invention, and all such modifications as would be obvious to one skilled in the art are intended to be included in the scope of the following claims.

What is claimed is:

1. An inflatable container of a number-sided hedron comprising:

a plurality of vertical air conduits disposed in at least one wall of the container, said container having an upper open end;

a horizontal air conduit disposed around a perimeter of the upper open end of said container and in communication with said plurality of vertical conduits at opposing edges of each wall of the container, said horizontal air conduit having at least three passages of a smaller diameter than said horizontal air conduit and disposed therein at corners of the container for bending the horizontal air conduit in accordance with the number of said at least three smaller diameter passages so as to form the number sided-hedron during inflation; and a one-way valve attached to said horizontal air conduit for communicating with said plurality of vertical air conduits through said horizontal air conduit, said one-way valve being provided with a detachable air pump, whereby upon inflating, the inflatable container is fully inflated by air-pumping through the one-way valve from a folded position thereof so that the inflatable container self-stands effectively.

2. The inflatable container according to claim 1, wherein said at least one wall includes two confronting walls having said plurality of vertical conduits formed therebetween.

3. The inflatable container according to claim 1, wherein said at least one wall includes four inflatable walls, each of said at least four inflatable walls including two confronting walls having said plurality of vertical conduits formed therebetween.

4. The inflatable container according to claim 1, wherein said smaller diameter passage numbers four.

5. The inflatable container according to claim 4, wherein said smaller diameter passage numbers five.

6. The inflatable container according to claim 4, wherein said smaller diameter passage numbers six.

7. The inflatable container according to claim 1, wherein said number sided-hedron is provided with quilt sealing disposed at each edge of the number sided-hedron.

8. The inflatable container according to claim 1, said inflatable container further comprising:

a lower portion of said container free of horizontal air conduits, whereby trash put into the inflatable container supports the upper portion including the inflated air conduits of the container.

9. The inflatable container according to claim 1, said inflatable container further comprising:

a pressure sensitive adhesive material disposed on the outer surface of one side of said horizontal air conduit and a protective strip for covering said pressure sensitive adhesive material and preventing it from contacting and adhering to a surface, whereby after removing the protective strip, the pressure sensitive adhesive material is adhered to a wall or a lower portion of a table or desk.

10. The inflatable container according to claim 1, said inflatable container further comprising:

a pressure sensitive adhesive material disposed on at least half of an inner surface portion of said opening of the container; and a protective strip for covering said pressure sensitive adhesive material and preventing it from contacting and adhering to a surface, whereby after trash is put into the inflated container and the protective strip is removed, the pressure sensitive adhesive material is adhered to an opposite portion of said opening of the container thereby sealing the container.

11. The inflatable container according to claim 1, wherein said at least one wall includes two inflatable walls, each of said two inflatable walls including two confronting walls having said plurality of vertical conduits formed therebetween.

12. The inflatable container according to claim 1, wherein said inflatable container is formed of a plastic material.

* * * * *